US007140890B1

(12) United States Patent
Ju

(10) Patent No.: US 7,140,890 B1
(45) Date of Patent: Nov. 28, 2006

(54) ELECTRICAL CONNECTOR ASSEMBLY CAPABLE OF BEING MOVED BY VACUUM-SUCTION DEVICE

(75) Inventor: Ted Ju, Keelung (TW)

(73) Assignee: Lotes Co., Ltd., Keelung City (TW)

( * ) Notice: Subject to any disclaimer, the term of this patent is extended or adjusted under 35 U.S.C. 154(b) by 0 days.

(21) Appl. No.: 11/384,273

(22) Filed: Mar. 21, 2006

(30) Foreign Application Priority Data

Aug. 6, 2005 (CN) ..... 2005 2 0104834

(51) Int. Cl.
*H01R 13/44* (2006.01)

(52) U.S. Cl. ..... 439/135; 439/41; 439/940

(58) Field of Classification Search ..... 439/41, 439/135, 940
See application file for complete search history.

(56) References Cited

U.S. PATENT DOCUMENTS 5,688,133 A * 11/1997 Ikesugi et al. ..... 439/135
6,905,353 B1 * 6/2005 Ma et al. ..... 439/135
6,945,799 B1 * 9/2005 Huang ..... 439/135

* cited by examiner

*Primary Examiner*—Tho D. Ta
(74) *Attorney, Agent, or Firm*—Jeffrey A. Lindeman; NixonPeabody, LLP

(57) ABSTRACT

An electrical connector assembly is adapted to be moved by a vacuum-suction device, and includes an electrical connector that has an insulating housing having opposite top and bottom surfaces. The top surface is formed with a receiving space that is defined by a surrounding wall and a bottom wall. The surrounding wall has an outer surface formed with engaging blocks. The bottom wall is formed with terminal-mounting holes mounted respectively with conductive terminals. A plate member is mounted on the insulating housing, and has a plate body disposed on the top surface of the insulating housing and adapted to be sucked by the vacuum-suction device, and a plurality of engaging hooks attached to the plate body and engaging detachably and respectively the engaging blocks.

2 Claims, 3 Drawing Sheets

ELECTRICAL CONNECTOR ASSEMBLY CAPABLE OF BEING MOVED BY VACUUM-SUCTION DEVICE

CROSS-REFERENCE TO RELATED APPLICATION

This application claims priority of Chinese Application No. 200520104834.3, filed on Aug. 6, 2005.

BACKGROUND OF THE INVENTION

1. Field of the Invention

The invention relates to an electrical connector assembly, more particularly to an electrical connector assembly capable of being moved by a vacuum-suction device.

2. Description of the Related Art

In an automated assembly process, an electrical connector assembly can be accurately and rapidly assembled to a predetermined position on a circuit board by means of a vacuum-suction device.

FIG. 1 illustrates a conventional electrical connector assembly that is capable of being moved by a vacuum-suction device (not shown), and that includes an electrical connector 3, a plate member 4, and an anchoring device 5.

The anchoring device 5 includes a mounting frame 51, a top cover 52 connected pivotally to a first side of the mounting frame 51 and having a central opening 520, and an L-shaped anchoring rod 53 having a coupling rod portion 531 that is mounted pivotally on a second side of the mounting frame 51 opposite to the first side, and an anchoring rod portion 532 connected to the coupling rod portion 531 and operable so as to engage detachably a third side of the mounting frame 51. The top cover 52 has an engaging tongue 521 that is pressed by a bent central section 5311 of the coupling rod portion 531 of the anchoring rod 53 when the anchoring rod portion 532 of the anchoring rod 53 engages the third side of the mounting frame 51.

The electrical connector 3 includes an insulating housing 30 mounted in the mounting frame 51 and confining a receiving space 33 that is defined by a surrounding wall 32, and a bottom wall 31 connected to a lower end of the surrounding wall 32 and formed with a plurality of through holes, and a plurality of conductive terminals 34 mounted respectively in the through holes in the bottom wall 31 of the insulating housing 30. Each conductive terminal 34 has a contacting and extending outwardly of a corresponding one of the through holes into the receiving space 33. The surrounding wall 32 of the insulating housing 30 has an inner surface formed with a plurality of positioning grooves 311, 312.

The plate member 4 is disposed within the receiving space 33 in the insulating housing 30, and can be sucked by a vacuum-suction nozzle of the vacuum suction device. The top cover 52 of the anchoring device 5 abuts against the plate member 4 when the anchoring rod portion 532 of the anchoring rod 53 engages the third side of the mounting frame 51. The plate member 4 has a plate body 40, and a plurality of positioning extensions 41, 42 extending outwardly from a periphery of the plate body 40 and engaged respectively in the positioning grooves 311, 312 in the insulating housing 30 such that the plate member 4 is positioned relative to the insulating housing 30. However, the insulating housing 30 is made at relatively high costs.

SUMMARY OF THE INVENTION

Therefore, the object of the present invention is to provide an electrical connector assembly that can be manufactured at relatively low costs.

According to the present invention, there is provided an electrical connector assembly adapted to be moved by a vacuum-suction device. The electrical connector assembly comprises:

an electrical connector including an insulating housing having opposite top and bottom surfaces, the top surface being formed with a receiving space that is defined by a surrounding wall, and a bottom wall connected to a lower end of the surrounding wall, the surrounding wall having an outer surface formed with a plurality of engaging blocks, the bottom wall being formed with a plurality of terminal-mounting holes, and a plurality of conductive terminals mounted respectively in the terminal-mounting holes in the bottom wall of the insulating housing; and a plate member mounted on the insulating housing and having a plate body disposed on the top surface of the insulating housing and adapted to be sucked by the vacuum-suction device, and a plurality of engaging hooks attached to the plate body and engaging detachably and respectively the engaging blocks on the outer surface of the surrounding wall of the insulating housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
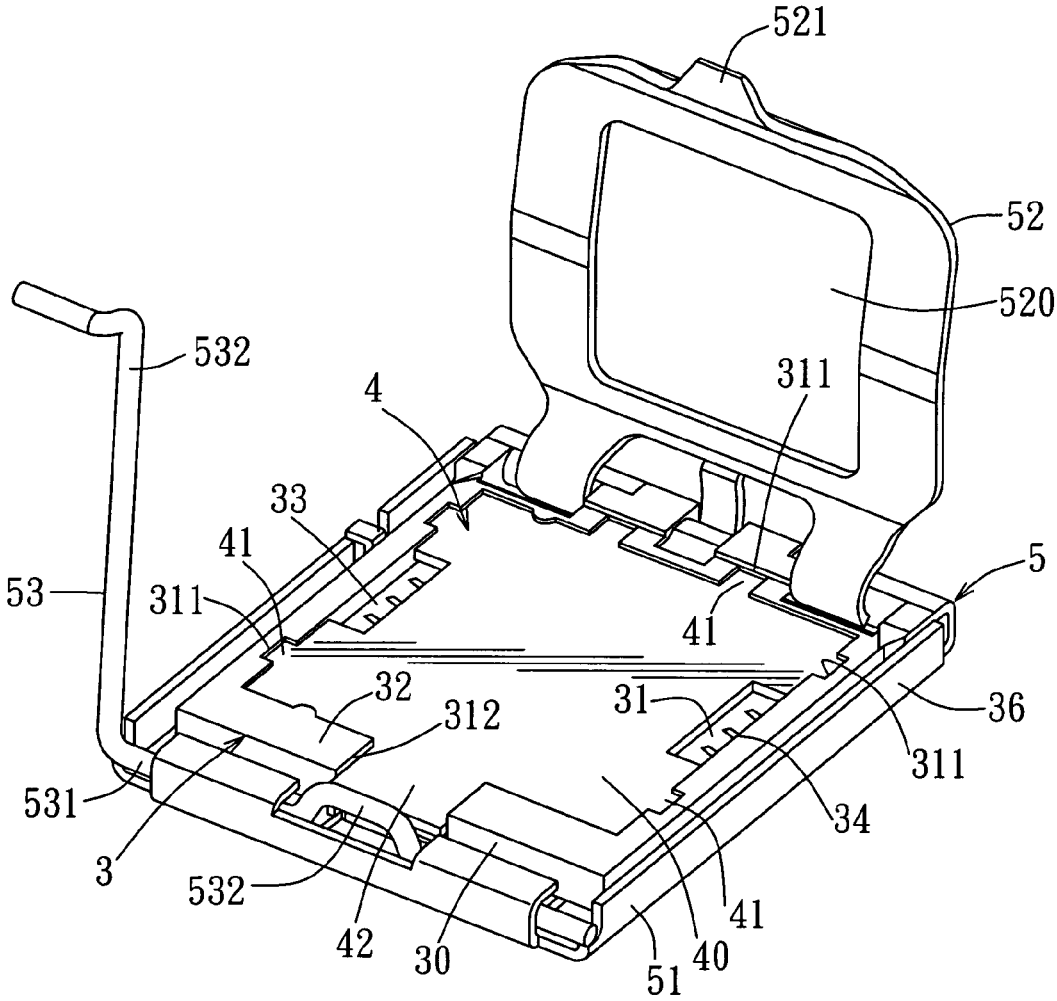
FIG. 1 PRIOR ART
FIG. 1 is a perspective view of a conventional electrical connector assembly.
Figure 2:
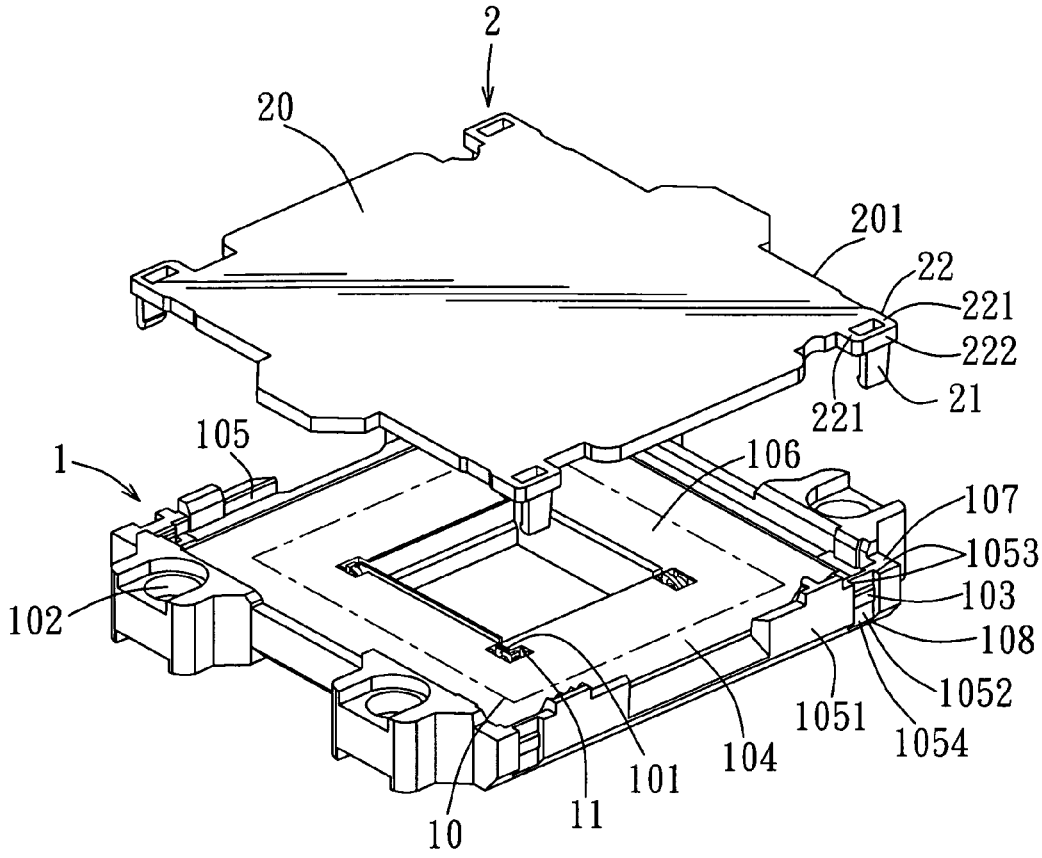
FIG. 2 is a partly exploded perspective view showing the preferred embodiment of an electrical connector assembly according to the present invention.
Figure 3:
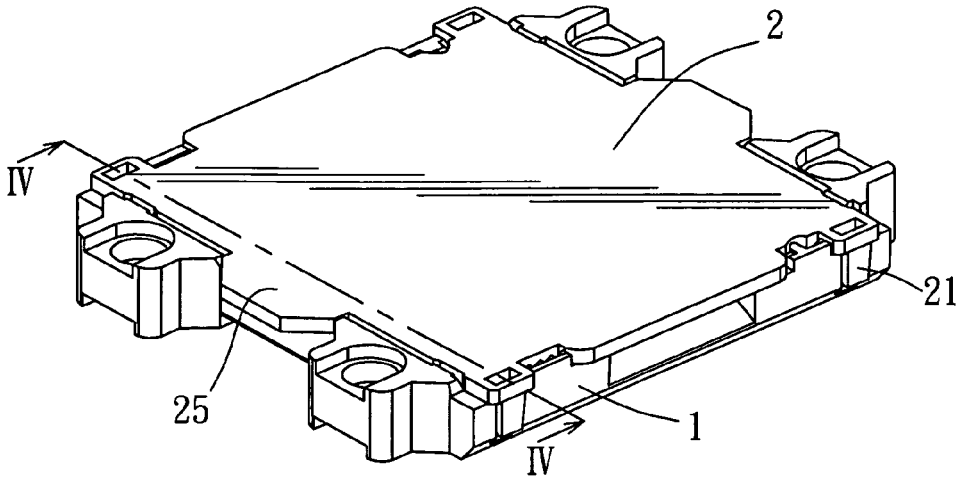
FIG. 3 is an assembled perspective view of the preferred embodiment.
Figure 4:
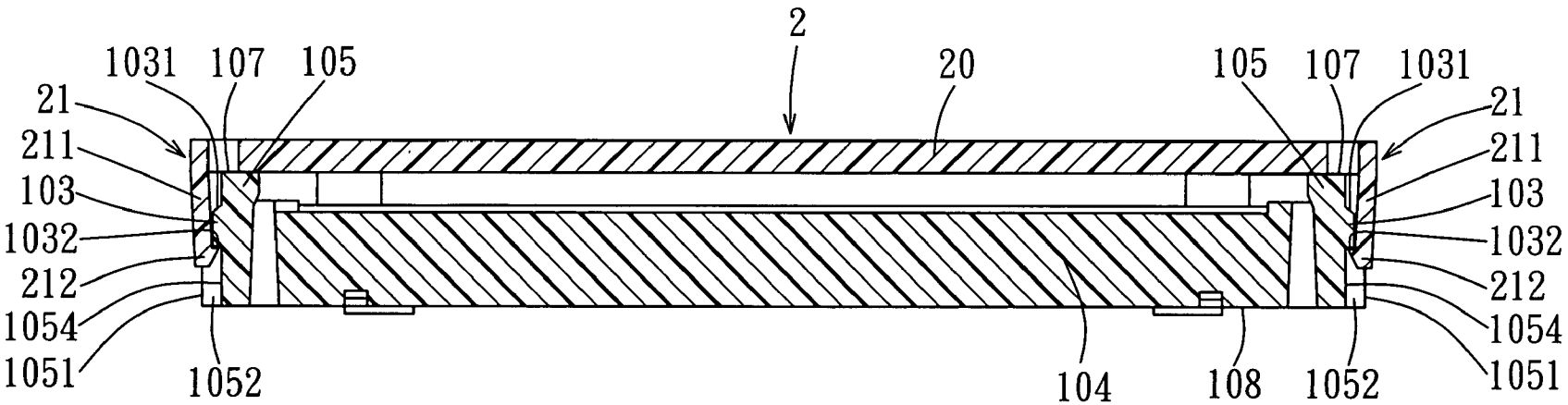
FIG. 4 is a schematic sectional view taken along line IV—IV in FIG. 3.

Referring to FIGS. 2 to 4, the preferred embodiment of an electrical connector assembly according to the present invention is shown to include an electrical connector 1 and a plate member 2. The electrical connector assembly is capable of being moved by a vacuum-suction device (not shown) to a predetermined position on a circuit board (not shown) during an automated assembly process.

The electrical connector 1 includes an insulating housing 10 and a plurality of conductive terminals 11.

The insulating housing 10 has opposite top and bottom surfaces 107, 108. The top surface 107 is made of plastic, and is formed with a receiving space 106 adapted for receiving a semiconductor device (not shown), such as a land grid array package, after the insulating housing 10 is mounted on the circuit board. The receiving space 106 is defined by a surrounding wall 105, and a bottom wall 104 connected to a lower end of the surrounding wall 105. The bottom wall 104 is formed with a plurality of terminal-mounting holes 101, as shown in FIG. 2. The surrounding wall 105 has an outer surface 1051 formed with a plurality of engaging blocks 103. In this embodiment, the outer surface 1051 of the surrounding wall 105 is further formed with a plurality of guiding grooves 1052, each of which is defined by opposite lateral walls 1053, and a groove bottom wall 1054 connected to the lateral walls 1053 and formed with a corresponding one of the engaging blocks 103. Each engaging block 103 has an inclined top guiding face 1031, and a bottom face 1032 opposite to the top guiding face 1031, as best shown in FIG. 4.

The conductive terminals 11 are mounted respectively in the terminal-mounting hole 101 in the bottom wall 104 of the insulating housing 10, as shown in FIG. 2.

The plate member 2 is mounted on the insulating housing 10 of the electrical connector 1, and has a plate body 20 and a plurality of engaging hooks 21. The plate body 20 is disposed on the top surface 107 of the insulating housing 10, and is adapted to be sucked by a vacuum-suction nozzle of the vacuum-suction device. The engaging hooks 21 are attached to the plate body 20, and engage detachably and respectively the engaging blocks 103 on the outer surface 1051 of the surrounding wall 105 of the insulating housing 10. In this embodiment, each of the engaging hooks 21 of the plate member 2 has a resilient arm portion 211 extending downwardly from a periphery 201 of the plate body 20 of the plate member 2 and disposed between the lateral walls 1053 defining a corresponding one of the guiding grooves 1052 in the outer surface 1051 of the surrounding wall 105 of the insulating housing 10, and a hook portion 212 connected to the arm portion 211, guided by the top guiding face 1031 of the engaging block 103 on the groove bottom wall 1054 defining the corresponding one of the guiding grooves 1052 in the outer surface 1051 of the surrounding wall 105 of the insulating housing 10, and engaging releasably the bottom face 1032 of the engaging block 103 on the groove bottom wall 1054 defining the corresponding one of the guiding grooves 1052 in the outer surface 1051 of the surrounding wall 105 of the insulating housing 10. In this embodiment, the periphery 201 of the plate body 20 of the plate member 2 is formed with a plurality of U-shaped integral lugs 22, each of which includes two parallel side bar portions 221 extending outwardly from the periphery 201 of the plate body 20 and having outer ends, and a connecting bar portion 222 interconnecting the outer ends of the side bar portions 221 and formed with a corresponding one of the engaging hooks 21.

In such a configuration, the plate body 20 of the plate member 2 is spaced apart from the bottom wall 104 of the insulating housing 10, thereby preventing deformation of the conductive terminals 11 during assembly. It is noted that, due to the engagement between the engaging hooks 21 of the plate member 2 and the engaging blocks 103 of the insulating housing 10, the electrical connector assembly of the present invention can be easily operated, and has a relatively simple structure as compared to that of the aforesaid conventional electrical connector assembly, thereby resulting in relatively low manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical connector assembly adapted to be moved by a vacuum-suction device, said electrical connector assembly comprising:

an electrical connector including an insulating housing having opposite top and bottom surfaces, said top surface being formed with a receiving space that is defined by a surrounding wall, and a bottom wall connected to a lower end of said surrounding wall, said surrounding wall having an outer surface formed with a plurality of engaging blocks, said bottom wall being formed with a plurality of terminal-mounting holes, and a plurality of conductive terminals mounted respectively in said terminal-mounting holes in said bottom wall of said insulating housing; and a plate member mounted on said insulating housing and having a plate body disposed on said top surface of said insulating housing and adapted to be sucked by the vacuum-suction device, and a plurality of engaging hooks attached to said plate body and engaging detachably and respectively said engaging blocks on said outer surface of said surrounding wall of said insulating housing; wherein:

said outer surface of said surrounding wall of said insulating housing is further formed with a plurality of guiding grooves, each of which is defined by opposite lateral walls, and a groove bottom wall connected to said lateral walls and formed with a corresponding one of said engaging blocks;

each of said engaging blocks having an inclined top guiding face, and a bottom face opposite to said top guiding face; and each of said engaging hooks of said plate member having a resilient arm portion extending downwardly from a periphery of said plate body of said plate member and disposed between said lateral walls defining a corresponding one of said guiding grooves in said outer surface of said surrounding wall of said insulating housing, and a hook portion connected to said arm portion, guided by said top guiding face of said engaging block on said groove bottom wall defining the corresponding one of said guiding grooves in said outer surface of said surrounding wall of said insulating housing, and engaging releasably said bottom face of said engaging block on said groove bottom wall defining the corresponding one of said guiding grooves in said outer surface of said surrounding wall of said insulating housing.

2. The electrical connector assembly as claimed in claim 1, wherein said periphery of said plate body of said plate member is formed with a plurality of U-shaped integral lugs, each of which includes two parallel side bar portions extending outwardly from said periphery of said plate body and having outer ends, and a connecting bar portion interconnecting said outer ends of said side bar portions and formed with a corresponding one of said engaging hooks.

* * * * *